US007789705B2

(12) United States Patent
Morgan

(10) Patent No.: US 7,789,705 B2
(45) Date of Patent: Sep. 7, 2010

(54) CONTACT MODULE FOR AN ELECTRICAL CONNECTOR HAVING PROPAGATION DELAY COMPENSATION

(75) Inventor: Chad William Morgan, Woolwich Township, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/178,336

(22) Filed: Jul. 23, 2008

(65) Prior Publication Data

US 2010/0022129 A1 Jan. 28, 2010

(51) Int. Cl.
*H01R 13/648* (2006.01)

(52) U.S. Cl. ..... 439/607.07; 439/607.05

(58) Field of Classification Search ..... 439/607.05–607.16

See application file for complete search history.

(56) References Cited

U.S. PATENT DOCUMENTS

| | | | | |
|---|---|---|---|---|
| 6,379,188 | B1 * | 4/2002 | Cohen et al. | 439/607.07 |
| 6,692,272 | B2 * | 2/2004 | Lemke et al. | 439/108 |
| 7,281,950 | B2 | 10/2007 | Belopolsky | |
| 7,316,585 | B2 * | 1/2008 | Smith et al. | 439/607.11 |
| 7,513,798 | B2 * | 4/2009 | Smith | 439/607.05 |
| 2008/0188095 | A1 * | 8/2008 | Christopher et al. | 439/66 |

* cited by examiner

*Primary Examiner*—Michael C Zarroli

(57) ABSTRACT

A contact module is provided for an electrical connector. The contact module includes a lead frame. The lead frame includes first and second differential pairs of terminals. Each of the terminals extends between a mating edge portion and a mounting edge portion. A first dielectric body surrounds at least a portion of the first differential pair of terminals. The first dielectric body includes a first dielectric constant. A second dielectric body surrounds at least a portion of the second differential pair of terminals. The second dielectric body includes a second dielectric constant that is different than the first dielectric constant of the first dielectric body.

21 Claims, 7 Drawing Sheets

CONTACT MODULE FOR AN ELECTRICAL CONNECTOR HAVING PROPAGATION DELAY COMPENSATION

BACKGROUND OF THE INVENTION

The subject matter described and/or illustrated herein relates generally to electrical connectors, and more particularly, to propagation delay compensation for an electrical connector.

In a traditional approach for interconnecting circuit boards, one circuit board serves as a back plane and the other as a daughter board. The back plane typically has a connector, commonly referred to as a header, that includes a plurality of signal pins or contacts which connect to conductive traces on the back plane. The daughter board connector, commonly referred to as a receptacle, also includes a plurality of contacts or pins. Typically, the receptacle is a right angle connector that interconnects the back plane with the daughter board so that signals can be routed therebetween. The right angle connector typically includes a mating face that receives the plurality of signal pins from the header on the back plane, and contacts that connect to the daughter board.

Some right angle connectors include a plurality of contact modules that are received in a housing. Each contact module includes a lead frame having a plurality of electrical terminals encased within a body. The terminals have typically been arranged in a single column within the body, or "in-column". However, because each of the terminals within the single column has a different length, the time it takes an electrical signal to travel along each terminal, commonly referred to as propagation delay, is different. In some right angle connectors, adjacent terminals within the column are arranged as differential pairs. Because the two terminals within a differential pair are arranged in-column relative to each other, the two terminals within a differential pair have different propagation delays than each other. Some known contact modules have arranged the two terminals of each differential pair side-by-side, or "in-row", such that the two terminals within a differential pair have the same length as each other. However, because the differential pairs of terminals are still arranged in-column relative to each other, each differential pair still has a different propagation delay than every other differential pair within the contact module.

A need remains for a right angle connector having a reduced propagation delay difference between different terminals of the connector. For example, a need remains for a right angle connector have a reduced propagation delay difference between different differential pairs within a column of terminals.

BRIEF DESCRIPTION OF THE INVENTION

In one embodiment, a contact module is provided for an electrical connector. The contact module includes a lead frame. The lead frame includes first and second differential pairs of terminals. Each of the terminals extends between a mating edge portion and a mounting edge portion. A first dielectric body surrounds at least a portion of the first differential pair of terminals. The first dielectric body includes a first dielectric constant. A second dielectric body surrounds at least a portion of the second differential pair of terminals. The second dielectric body includes a second dielectric constant that is different than the first dielectric constant of the first dielectric body.

In another embodiment, a contact module is provided for an electrical connector. The contact module includes a lead frame. The lead frame includes first and second differential pairs of terminals. Each of the terminals extends between a mating edge portion and a mounting edge portion. A first dielectric body surrounds at least a portion of the first differential pair of terminals. The first dielectric body includes a first air gap. A second dielectric body surrounds at least a portion of the second differential pair of terminals. The second dielectric body includes a second air gap that is smaller than the first air gap of the first dielectric body.

In another embodiment, an electrical connector is provided. The electrical connector includes a housing and a contact module mounted in the housing. The contact module includes a lead frame. The lead frame includes first and second differential pairs of terminals. Each terminal extends between a mating edge portion and a mounting edge portion. A first dielectric body surrounds at least a portion of the first differential pair of terminals. The first dielectric body includes a first dielectric constant. A second dielectric body surrounds at least a portion of the second differential pair of terminals. The second dielectric body includes a second dielectric constant that is different than the first dielectric constant of the first dielectric body.

DETAILED DESCRIPTION OF THE INVENTION

Figure 1:
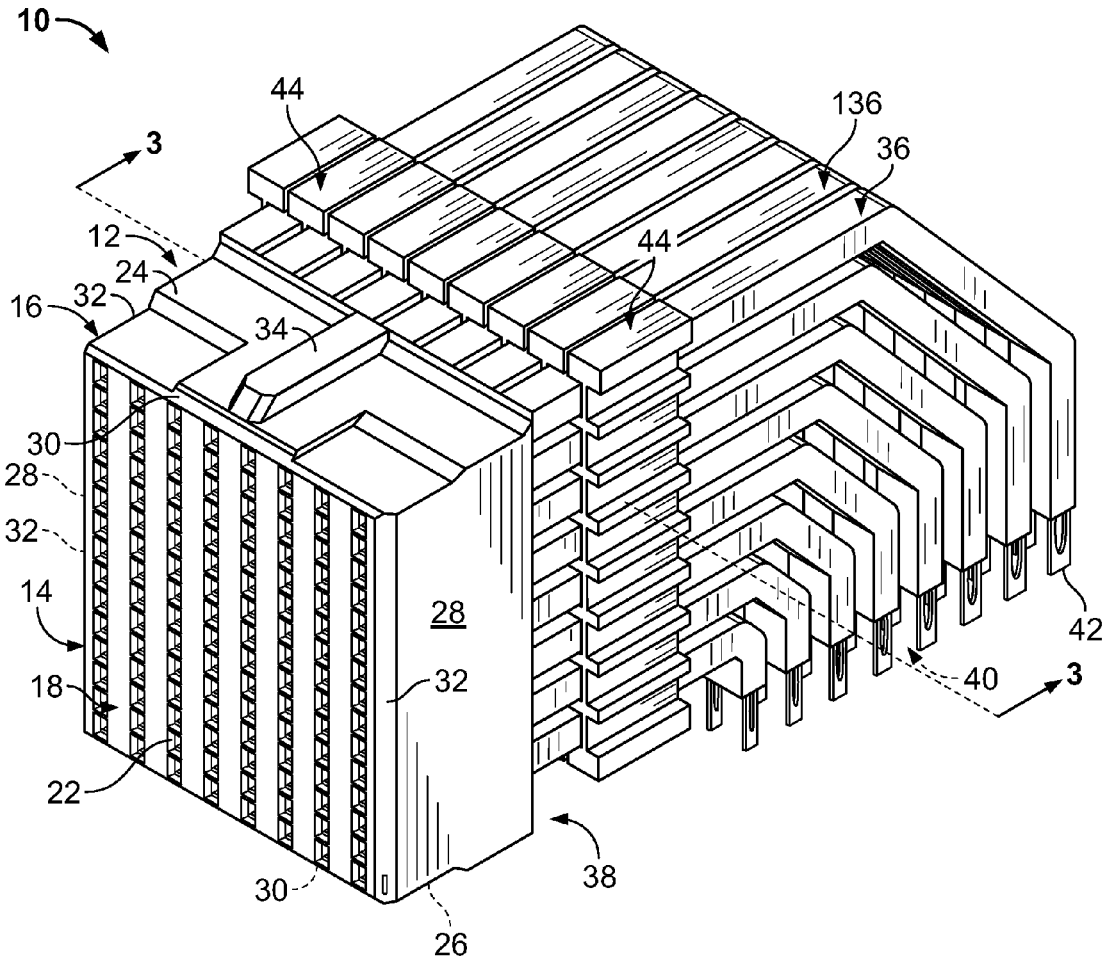
FIG. 1 is a perspective view of an exemplary embodiment of an electrical connector.

FIG. 1 is a perspective view of an exemplary embodiment of an electrical connector 10. The connector 10 includes a dielectric housing 12 having a forward mating end 14 that includes a shroud 16 and a mating face 18. The mating face 18 includes a plurality of mating contacts 20 (shown in FIGS. 4 and 5) and 120 (shown in FIGS. 6 and 7), such as, for example, contacts within contact cavities 22, that are configured to receive corresponding mating contacts (not shown) from a mating connector (not shown). The shroud 16 includes an upper surface 24 and a lower surface 26 between opposite sides 28. The upper and lower surfaces 24 and 26, respectively, each includes an optional chamfered forward edge portion 30. The sides 28 each include optional chamfered side edge portions 32. Optionally, an alignment rib 34 is formed on the upper shroud surface 24 and lower shroud surface 26. The chamfered edge portions 30 and 32 and the alignment ribs 34 cooperate to bring the connector 10 into alignment with the mating connector during the mating process so that the contacts in the mating connector are received in the contact cavities 22 without damage.

A plurality of contact modules 36 and 136 are received in the housing 12 from a rearward end 38. The contact modules 36 and 136 define a connector mounting face 40. The connector mounting face 40 includes a plurality of mounting contacts 42 and 142 (shown in FIGS. 6 and 7) that are configured to be mounted to a substrate (not shown), such as, but not limited to, a circuit board. In the exemplary embodiment, the mounting face 40 is approximately perpendicular to the mating face 18 such that the connector 10 interconnects electrical components that are approximately at a right angle to one another. However, the mounting face 40 may be angled at any other suitable angle relative to the mating face 18 that enables the connector 10 to interconnect electrical components that are oriented at any other angle relative to each other. In the exemplary embodiment, the housing 12 holds two different types of contact modules 36 (shown in FIGS. 3-5) and 136 (shown in FIGS. 3, 6, and 7). Alternatively, the housing 12 may hold only a single type of contact module 36, such as, but not limited to, only the contact modules 36, only the contact modules 136, or only another type of contact module (not shown). Moreover, in another alternative embodiment, the housing 12 may hold one or more of the contact modules 136 and one or more other type(s) of contact modules, or one or more of the contact modules 136 and one or more other type(s) of contact modules. The housing 12 may hold any number of contact modules 36, any number of contact modules 136, and any number of contact modules overall. As will be described below, in the exemplary embodiment, when the contact modules are held by the housing 12 the contact modules are held together by a plurality of holders 44.

Figure 2:
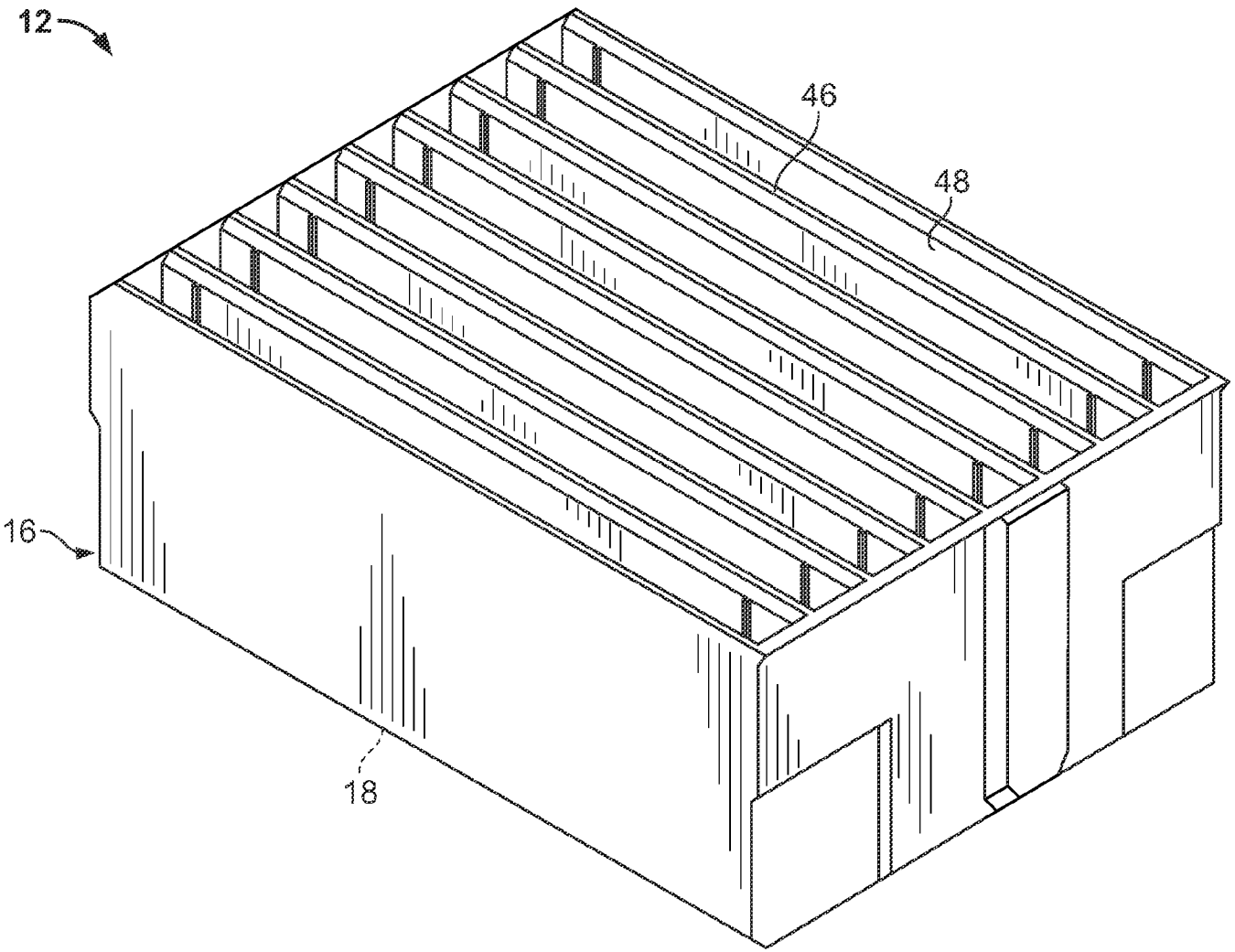
FIG. 2 is a perspective view of an exemplary embodiment of a housing of the electrical connector shown in FIG. 1.

FIG. 2 is a perspective view of the housing 12. The housing 12 includes a plurality of dividing walls 46 that define a plurality of chambers 48. The chambers 48 receive a forward portion of the contact modules 36 (FIGS. 1 and 3-5) and 136 (FIGS. 1, 3, 6, and 7). The chambers 48 stabilize the contact modules 36 and 136 when the contact modules 36 and 136 are loaded into the housing 12. In the exemplary embodiment, the chambers 48 each have about an equal width. However, one or more of the chambers 48 may have different widths for accommodating differently sized contact modules 36 and/or 136.

Figure 3:
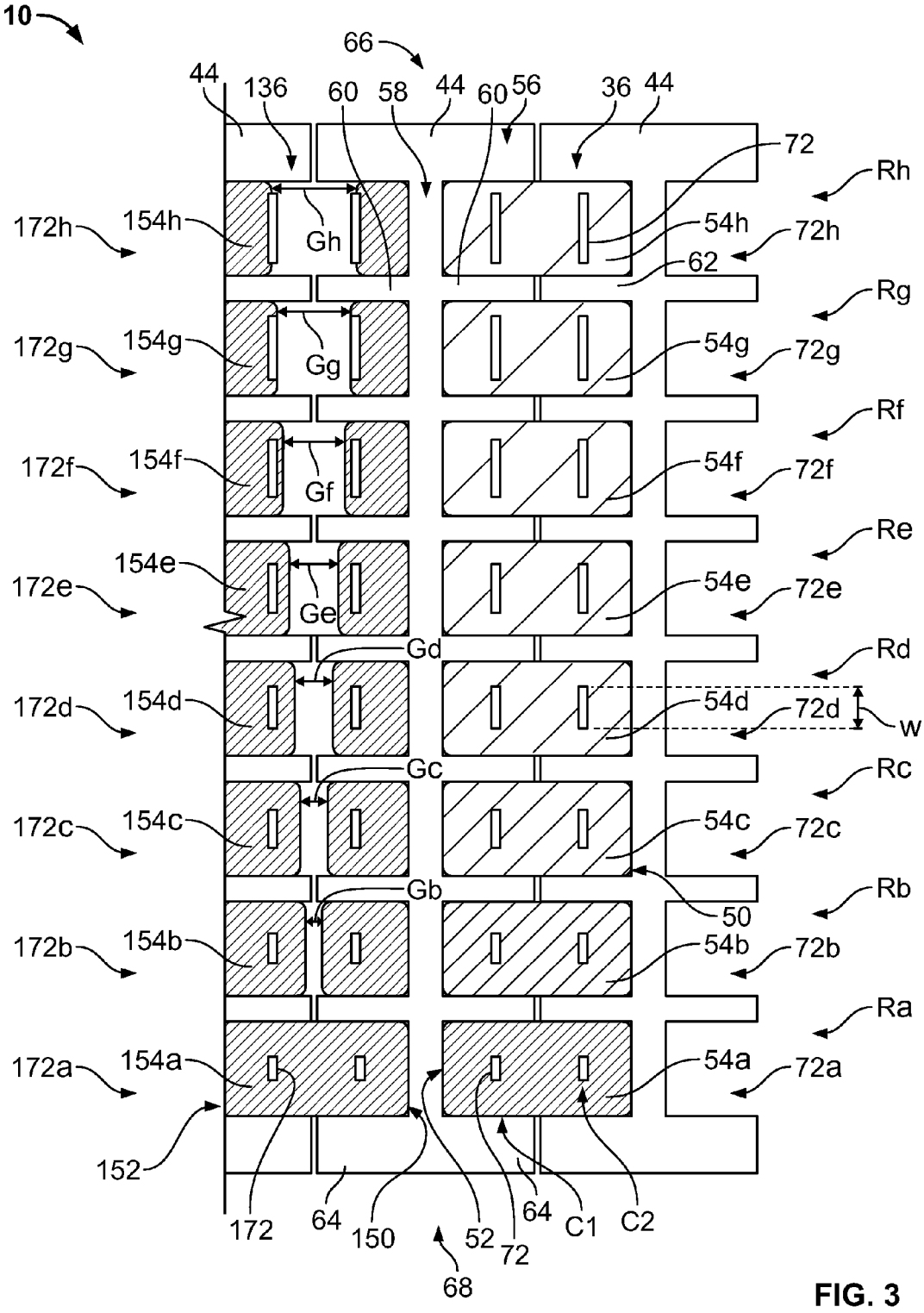
FIG. 3 is cross-sectional view of a portion of the electrical connector shown in FIG. 1 taken along line 3-3 of FIG. 1.

FIG. 3 is cross-sectional view of a portion of the electrical connector 10 taken along line 3-3 of FIG. 1. In the exemplary embodiment, the contact modules 36 and 136 are held together by the plurality of holders 44. Specifically, the holders 44 are positioned adjacent opposite side portions 50 and 52 and 150 and 152 of dielectric bodies 54*a-h* and 154*a-h* of each of the contact modules 36 and 136, respectively. Each holder 44 includes a body 56 having a central portion 58 and a plurality of extensions 60 that extend outwardly from the central portion 58 along a length L of the body 56. As can be seen in FIG. 3, the extensions 60 extend into gaps 62 between the dielectric bodies 54*a-h* and 154*a-h* of each adjacent contact module 36 and/or 136, respectively, to support the dielectric bodies 54*a-h* and 154*a-h* and hold the contact modules 36 and 136 together. The holders 44 may optionally include an extension 64 at opposite end portions 66 and/or 68 thereof for supporting the dielectric bodies 54*a*, 54*h*, 154*a*, and/or 154*h*. As used herein, a "contact module" may include one or more of the adjacent holders 44.

In addition or alternative to the holders 44, the contact modules 36 and 136 may each include any other suitable structure that enables the electrical connector 10 and the contact modules 36 and 136 to function as described and/or illustrated herein. Although each holder 44 is shown as having fourteen extensions 60 and four extensions 64, each holder 44 may include any number of the extension 60 and any number of the extensions 64 for supporting any number of dielectric bodies 54 and/or 154.

Figure 4:
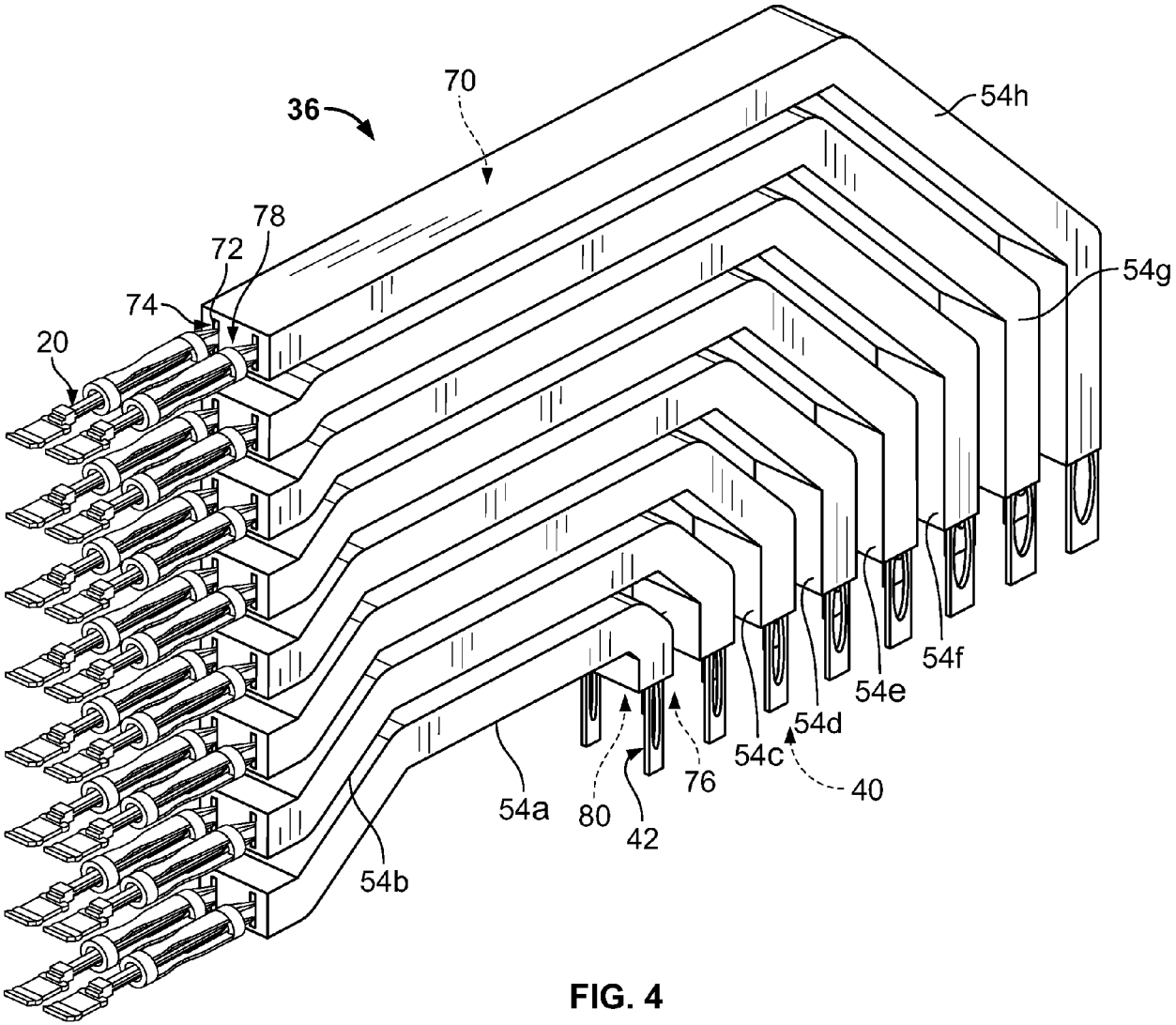
FIG. 4 is a perspective view of an exemplary embodiment of a contact module for use with the connector shown in FIG. 1.
Figure 5:
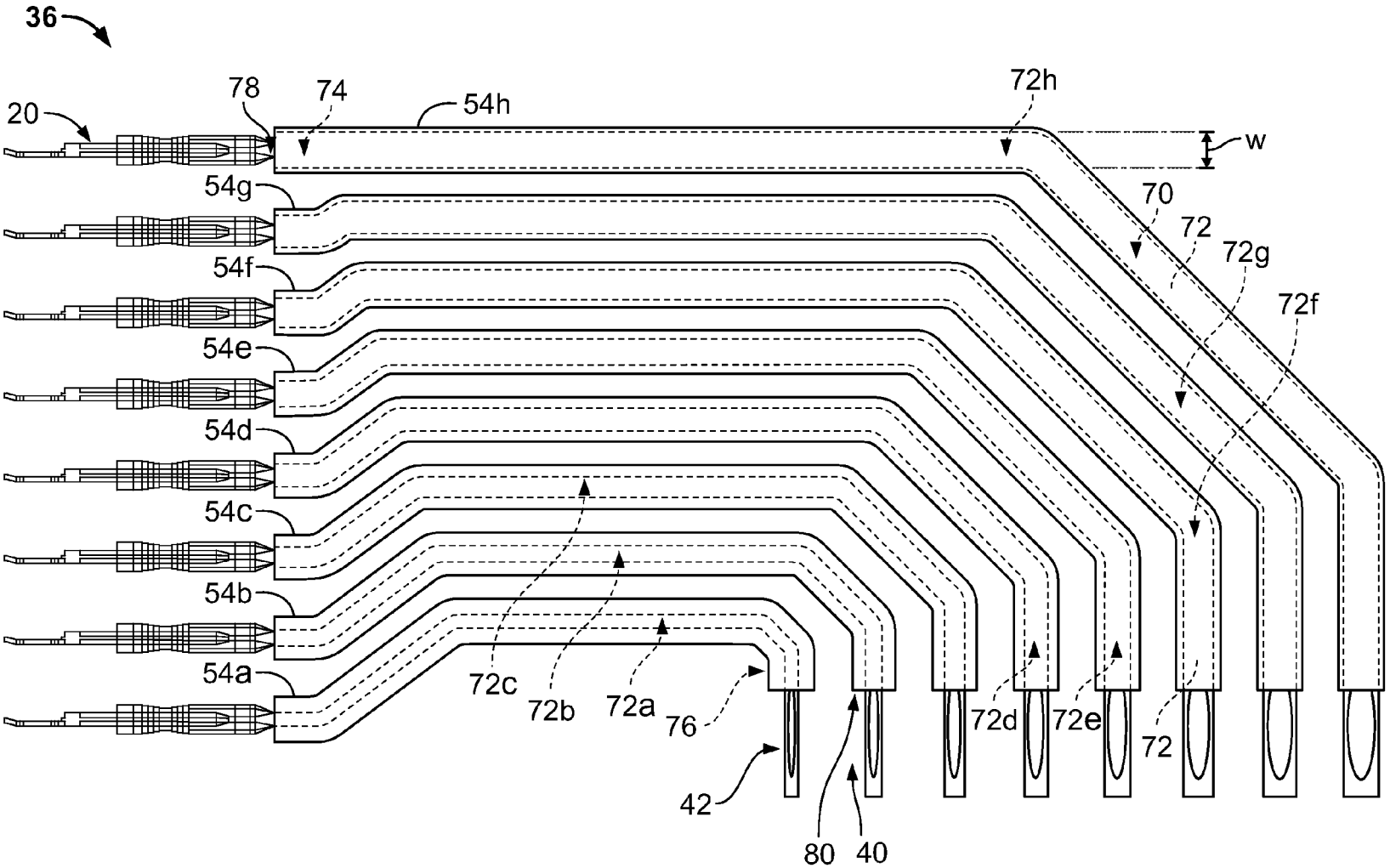
FIG. 5 is a side view of the contact module shown in FIG. 4.

FIGS. 4 and 5 are perspective and side views, respectively, of an exemplary embodiment of the contact module 36. Referring now to FIGS. 3-5, the contact module 36 includes a lead frame 70 (best seen in FIG. 5) that includes a plurality of electrical terminals 72. The terminals 72 extend along predetermined paths to electrically connect each mating contact 20 with each mounting contact 42. The terminals 72 extend between a mating edge portion 74 and a mounting edge portion 76. Each terminal 72 may be either a signal terminal, a ground terminal, or a power terminal. As best seen in FIG. 3, the terminals 72 are arranged in differential pairs 72*a-h*. Specifically, pairs 72*a-h* of the terminals 72 are arranged side-by-side in respective rows Ra-h. The rows Ra-h of differential pairs 72*a-h*, respectively, are arranged such that the terminals 72 of each differential pair 72*a-h* form a pair of columns $C_{1\ and\ 2}$ of terminals 72.

As is best seen in FIG. 5, the two terminals of each differential pair 72*a-h* are approximately the same length. However, each differential pair 72*a-h* has a different length than the other differential pairs 72*a-h*. Specifically, in the exemplary embodiment, beginning with the differential pair 72*a* having the smallest length, each successive differential pair 72*b-h* has a greater respective length than the preceding pair, with the differential pair 72*h* having the greatest length. Because of the different lengths, there may be propagation delay differences between the differential pairs 72*a-h*.

Each differential pair 72*a-h* of terminals 72 is at least partially encased, or surrounded, in a respective dielectric body 54*a-h*. In the exemplary embodiment, each body 54*a-h* extends between a mating face 78 and a mounting face 80 that defines a portion of the mounting face 40. The mating contacts 20 extend from the terminal mating edge portions 74 and the mating faces 78, and the mounting contacts 42 extend from the terminal mounting edge portions 76 and the mounting faces 80. In the exemplary embodiment, the mounting faces 80 are approximately perpendicular to the mating faces 78 such that the connector 10 interconnects electrical components that are approximately at a right angle to one another. However, the mounting faces 80 may be angled at any other suitable angle relative to the mating faces 78 that enables the connector 10 to interconnect electrical components that are oriented at any other angle relative to each other.

To compensate for the different propagation delays between one or more of the differential pairs 72*a-h*, the bodies 54*a-h* of one or more of the differential pairs 72*a-h* may be fabricated from different materials and/or different combinations of materials to provide one or more of the bodies 54*a-h* with different dielectric constants than one or more of the other bodies 54*a-h*. For example, the body 54 of a terminal 72 having a greater length than another terminal 72 may be provided with a lower dielectric constant than such other terminal 72. Likewise, and for example, the body 54 of a terminal 72 having a shorter length than another terminal 72 may be provided with a higher dielectric constant than such other terminal 72.

In the exemplary embodiment, each of the bodies 54*a-h* is fabricated from a different material and/or combination of materials than each of the other bodies 54*a-h* such that each of the bodies 54*a-h* has a different dielectric constant than each of the other bodies 54*a-h*. Specifically, beginning with the body 54*a* having the highest dielectric constant, each successive body 54*b-h* has a lower dielectric constant than the preceding body 54, with the body 54*h* having the lowest dielectric constant. The specific dielectric constants of each body 54*a-h* as well as the difference between the dielectric constants of each of the bodies 54*a-h* is selected to reduce the differences between the propagation delays of the differential pairs 72*a-h*.

In one specific example, the lengths of the differential pairs 72*a-h* are approximately 14.8 mm, approximately 18.5 mm, approximately 22.2 mm, approximately 25.8 mm, approximately 29.5 mm, approximately 33.1 mm, approximately 36.8 mm, and approximately 40.5 mm, respectively. In the example of this paragraph, materials(s) are selected for the bodies 54*a-h* such that the dielectric constants of the bodies 54*a-h* are approximately 3.50, approximately 2.75, approximately 2.30, approximately 2.02, approximately 1.81, approximately 1.66, approximately 1.54, and approximately 1.45, respectively, such that the difference between the propagation delays of each of the differential pairs 72*a-h* is reduced from approximately 25 ps in the case where all dielectric constants are approximately 3.5 to a propagation delay difference of less than approximately 10 ps between differential pairs 72*a-h* in each successive row.

Through the selection of different materials and/or combination of materials, any number of the bodies 54*a-h* may have a different dielectric constant than any number of the other bodies 54*a-h*. Moreover, the bodies 54*a-h* may have any pattern of different materials relative to each other that provides the bodies 54*a-h* with any pattern of dielectric constants. The material and/or combination of materials for each body 54*a-h* may be selected to provide the body 54 with any suitable dielectric constant that enables the electrical connector 10 (FIG. 1) and the contact module 36 to function as described herein, such as, but not limited to, between approximately 1.0 and approximately 4.0. The material and/or combination of materials for each body 54*a-h* may be selected to provide one or more of the terminals 72 with a propagation delay difference of any value as compared with one or more of the other terminals 72, such as, but not limited to, a propagation delay difference of between approximately 0 ps and approximately 10 ps.

Each body 54*a-h* may be fabricated from any suitable material(s), such as, but not limited to, glass, porcelain, plastics, and/or other polymers, such as, but not limited to, thermoplastics, such as, but not limited to, acrylonitrile butadiene styrene (ABS), acrylic, celluloid, ethylene vinyl alcohol (EVAL), fluoroplastics, ionomers, liquid crystal polymer (LCP), polyacetal (POM), polyacrylates, polyamide (PA), polyamide-imide (PAI), polyaryletherketone (PAEK), polybutylene terephthalate (PBT), polyethylene terephthalate (PET), polycarbonate (PC), polyketone (PK), polyester, polyethylene, polyetheretherketone (PEEK), polyetherimide (PEI), polyimide (PI), polylactic acid (PLA), polypropylene (PP), polystyrene (PS), polysulfone (PSU), and/or polyvinyl chloride (PVC). Non-polar plastics such as, but not limited to, fluoropolymers, polytetrafluoroethylene (PTFE), and/or polyethylene (PE) are other examples of materials that each body 54*a-h* may be fabricated from. Extruded plastics, such as, but not limited to, extruded polystyrene, are other examples of materials that each body 54*a-h* may be fabricated from. Still other examples that may be used to fabricate each body 54*a-h* include thermosets, such as, but not limited to, phenol formaldehyde resin, duroplast, polyester resin, and/or epoxy resin.

In some embodiments, the terminals 72 of one or more differential pairs 72*a-h* may have a different width W (best seen in FIG. 5) than the terminals of one or more other differential pairs 72*a-h*, for example to compensate for a change in an impedance of the terminals 72.

Although the contact module 36 is shown as having eight differential pairs 72*a-h* of terminals, the contact module 36 may include any number of differential pairs of terminals 72. Moreover, although the contact module 36 is shown as having sixteen terminals 72, the contact module 36 may include any number of terminals 72. Although one dielectric body 54*a-h* is shown for each differential pair 72*a-h*, the contact module 36 may include any number of dielectric bodies 54 for any at least partially surrounding any number of terminals 72.

In some alternative embodiments, the contact module 36 includes only a single column of terminals 72 such that each body 54 at least partially surrounds a single one of the terminals 72, wherein some adjacent pairs of terminals 72 within the single column are optionally arranged as differential pairs. In such an alternative embodiment, one or more of the bodies 54 within the single column may be provided with a different dielectric constant than one or more of the other bodies 54 through the selection of different materials and/or combinations of materials in the manner described herein.

Figure 6:
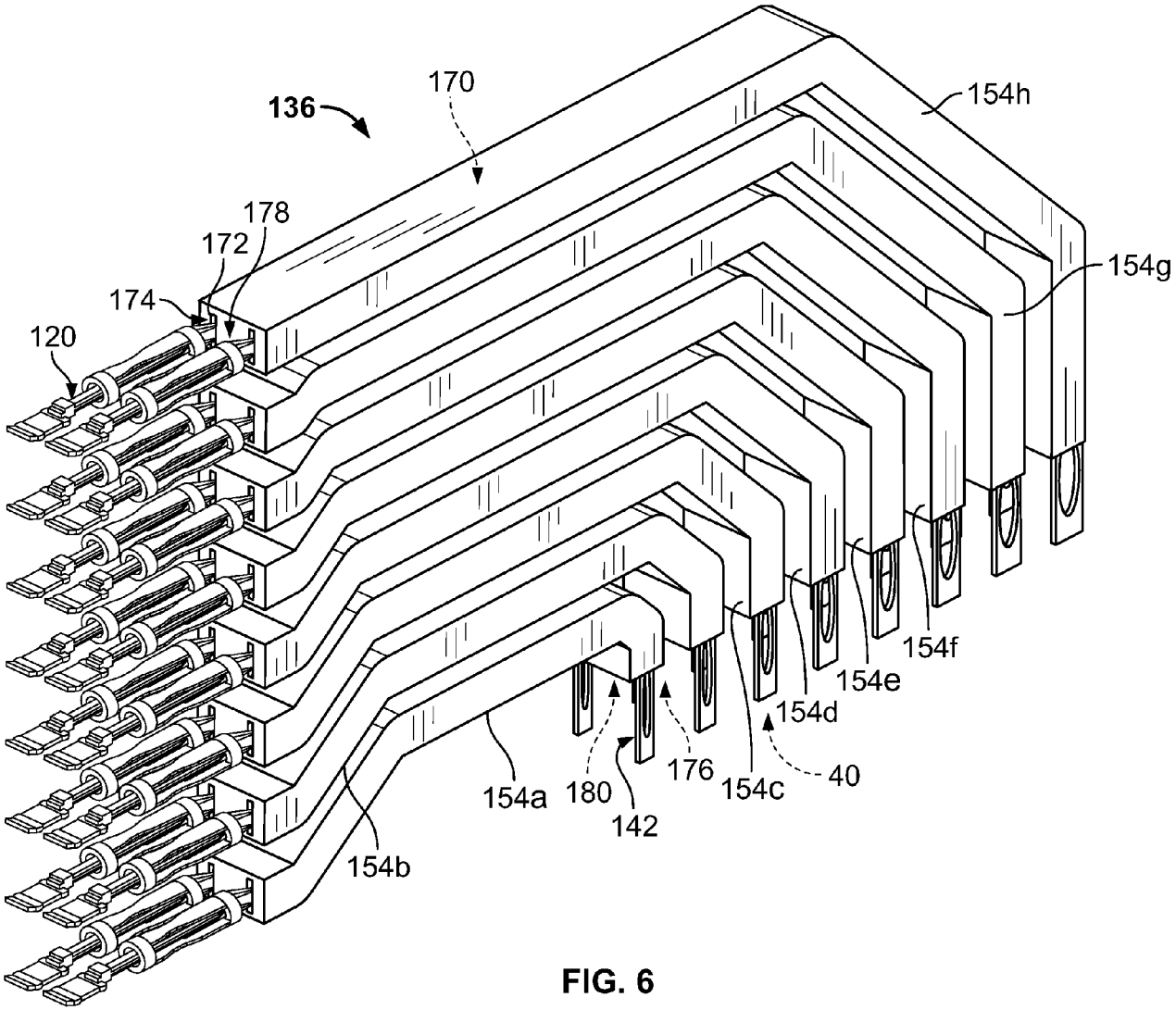
FIG. 6 is a perspective view of an exemplary embodiment of another contact module for use with the connector shown in FIG. 1.
Figure 7:
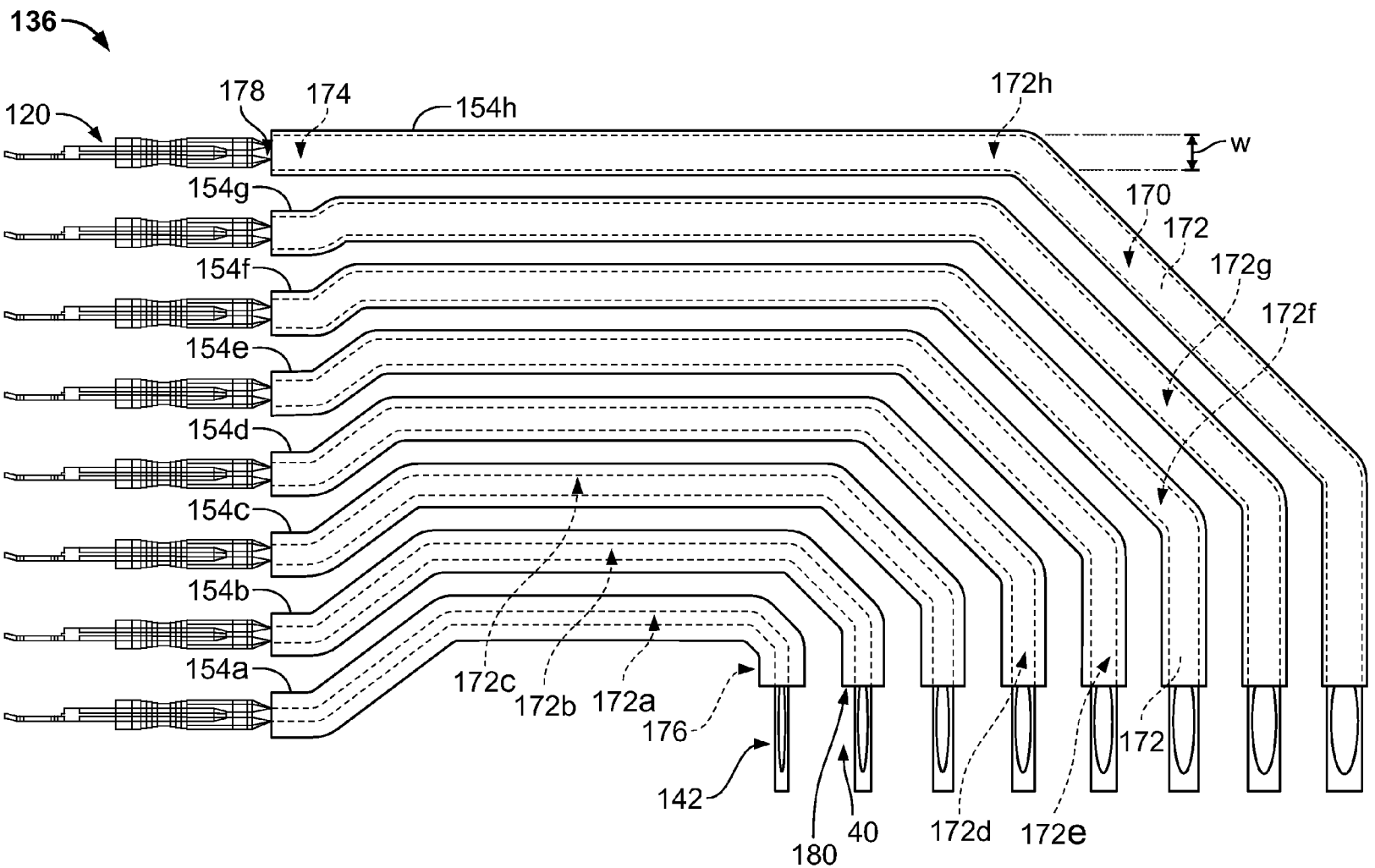
FIG. 7 is a side view of the contact module shown in FIG. 6.

FIGS. 6 and 7 are perspective and side views, respectively, of an exemplary embodiment of the contact module 136. Referring now to FIGS. 3, 6, and 7, the contact module 136 includes a lead frame 170 (best seen in FIG. 7) that includes a plurality of electrical terminals 172. The terminals 172 extend along predetermined paths to electrically connect each mating contact 120 with each mounting contact 142. The terminals 172 extend between a mating edge portion 174 and a mounting edge portion 176. Each terminal 72 may be either a signal terminal, a ground terminal, or a power terminal. As best seen in FIG. 3, the terminals 172 are arranged in differential pairs 172*a-h*.

Each differential pair 172*a-h* of terminals 172 is at least partially encased, or surrounded, in a respective dielectric body 154*a-h*. In the exemplary embodiment, the bodies 154*a-h* are each fabricated from the same material and/or combination of materials such that each of the bodies 154*a-h* has approximately the same dielectric constant. As best seen in FIG. 3, the bodies 154*b-g* each include an air gap Gb-g, respectively, extending along a portion of the length thereof, while the body 154*a* does not include an air gap. Despite the specific locations, shapes, and sizes shown, each air gap Gb-g may have any suitable location relative to the body 154, shape, size, and/or the like, that enables the body 154 to function as described herein.

In the exemplary embodiment, each body 154*a-h* extends between a mating face 178 and a mounting face 180 that defines a portion of the mounting face 40. The mating contacts 120 extend from the terminal mating edge portions 174 and the mating faces 178, and the mounting contacts 142 extend from the terminal mounting edge portions 176 and the mounting faces 180. In the exemplary embodiment, the mounting faces 180 are approximately perpendicular to the mating faces 178 such that the connector 10 (FIG. 1) interconnects electrical components that are approximately at a right angle to one another. However, the mounting faces 180 may be angled at any other suitable angle relative to the mating faces 178 that enables the connector 10 to interconnect electrical components that are oriented at any other angle relative to each other.

To compensate for the different propagation delays between one or more of the differential pairs 172*a-h*, the bodies 154*a-h* of one or more of the differential pairs 172*a-h* may be provided with a differently sized, located, shaped, and/or the like air gap G, and/or no air gap G, to provide one or more of the bodies 154*a-h* with different effective dielectric constants than one or more of the other bodies 154*a-h*. In the exemplary embodiment, each of the bodies 154*b-h* is provided with a differently sized air gap G, while the body 154*a* has no air gap G, such that each of the bodies 154*a-h* has a different effective dielectric constant than each of the other bodies 154*a-h*. Specifically, beginning with the body 154*b* having the smallest air gap Gb, each successive body 154*c-h* has a larger air gap Gc-h than the preceding body 154, with the body 154*h* having the largest air gap Gh and the body 154*a* having no air gap G. Beginning with the body 154*a* having the highest effective dielectric constant, each successive body 154*b-h* has a lower effective dielectric constant than the preceding body 154, with the body 154*a* having the highest effective dielectric constant. The specific effective dielectric constants of each body 154*a-h* as well as the differences between the effective dielectric constants of each of the bodies 154*a-h* is selected to reduce the differences between the propagation delays of the differential pairs 172*a-h*.

In one specific example, the lengths La-h of the differential pairs 172*a-h* are approximately 14.8 mm, approximately 18.5 mm, approximately 22.2 mm, approximately 25.8 mm, approximately 29.5 mm, approximately 33.1 mm, approximately 36.8 mm, and approximately 40.5 mm, respectively. In the example of this paragraph, the air gaps Gb-h vary such that the effective dielectric constants of the bodies 154*a-h* are approximately 3.50, approximately 2.75, approximately 2.30, approximately 2.02, approximately 1.81, approximately 1.66, approximately 1.54, and approximately 1.45, respectively, such that the difference between the propagation delays of each of the differential pairs 172*a-h* is between approximately 0 ps and approximately 10 ps.

Through the selection of differently sized, shaped, located, and/or the like air gaps G, and/or no air gap G, any number of the bodies 154*a-h* may have a different dielectric constant than any number of the other bodies 154*a-h*. Moreover, the bodies 154*a-h* may have any pattern of differently sized, shaped, located, and/or the like air gaps G relative to each other that provides the bodies 154*a-h* with any pattern of dielectric constants. The size, shape, location, and/or the like of the air gap G for each body 154*a-h*, and/or whether the body 154 has an air gap G, may be selected to provide the body 154 with any suitable dielectric constant that enables the electrical connector 10 and the contact module 136 to function as described herein, such as, but not limited to, between approximately 1.0 and approximately 4.0. The size, shape, location, and/or the like of the air gap G for each body 154*a-h*, and/or whether the body 154 has an air gap G, may be selected to provide one or more of the terminals 172 with a propagation delay difference of any value as compared with one or more of the other terminals 172, such as, but not limited to, a propagation delay difference of between approximately 0 ps and approximately 10 ps.

Each body 154*a-h* may be fabricated from any suitable material(s), such as, but not limited to, the exemplary materials described herein with respect to the bodies 54*a-h* (FIGS. 3-5). Although the contact module 136 is shown as having eight differential pairs 172*a-h* of terminals, the contact module 136 may include any number of differential pairs of terminals 172. Moreover, although the contact module 136 is shown as having sixteen terminals 172, the contact module 136 may include any number of terminals 172. Although one dielectric body 154*a-h* is shown for each differential pair 172*a-h*, the contact module 136 may include any number of dielectric bodies 154 for at least partially surrounding any number of terminals 172. Although seven of the eight bodies 154*a-h* are shown as having an air gap G, any number of the bodies 154 may include an air gap G.

In some embodiments, the terminals 172 of one or more differential pairs 172*a-h* optionally have a different width than the terminals of one or more other differential pairs 172*a-h*, for example to compensate for a change in an impedance of the terminals 172.

In some alternative embodiments, the contact module 136 includes only a single column of terminals 172, wherein some adjacent pairs of terminals 172 within the single column are optionally arranged as differential pairs. In such an alternative embodiment, one or more of the bodies 154 within the single column may be provided with a different dielectric constant than one or more of the other bodies 154 through the selection of different air gaps G, and/or no air gap G, in the manner described herein.

Although the selection of different materials and/or combinations thereof for the bodies 54 and the selection of different air gaps G (and/or no air gap G) for the bodies 154 are described and illustrated separately herein, the selection of different materials and/or combinations thereof for the bodies at least partially surrounding the terminals of a contact module may be used in combination with the selection of different air gaps G (and/or no air gap G) for the bodies to provide the bodies with different dielectric constants. In other words, the embodiment of FIGS. 4 and 5 may be combined with the embodiment of FIGS. 6 and 7.

The mounting contacts 42 and 142 may each be any suitable type of electrical contact that enables the mounting contacts 42 and 142 to function as described herein, such as, but not limited to, a press-fit type, a surface mount type, and/or a solder tail type. The mating contacts 20 and 120 may each be any suitable type of electrical contact that enables the mating contacts 20 and 120 to function as described herein, such as, but not limited to, a press-fit type, a surface mount type, and/or a solder tail type.

The embodiments described and/or illustrated herein provide a right angle connector that may have a reduced propagation delay difference between different terminals of the connector. The embodiments described and/or illustrated herein provide a right angle connector that may have a reduced propagation delay difference between different differential pairs of terminals. The embodiments described and/or illustrated herein provide a right angle connector that may have a reduced propagation delay difference between different differential pairs within a column of terminals. Reducing propagation delay difference between differential pairs of different lengths may allow other electrical design strategies to be more effective, such as, but not limited to, far end noise cancellation between two footprints of a connector.

While the connector 10 is described and illustrated herein with particular reference to a receptacle connector, it is to be understood that the benefits herein described are also applicable to other connectors in other embodiments. The description and illustration herein is therefore provided for purposes of illustration, rather than limitation, and is but one potential application of the subject matter described and/or illustrated herein.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated has been described in terms of various specific embodiments, those skilled in the art will recognize that the subject matter described and/or illustrated can be practiced with modification within the spirit and scope of the claims.

What is claimed is:

1. A contact module for an electrical connector, said contact module comprising:

a lead frame comprising first and second differential pairs of terminals, each of the terminals extending between a mating edge portion and a mounting edge portion;

a first dielectric body surrounding at least a portion of the first differential pair of terminals, the first dielectric body comprising a first dielectric constant; and a second dielectric body surrounding at least a portion of the second differential pair of terminals, the second dielectric body comprising a second dielectric constant that is different than the first dielectric constant of the first dielectric body.

2. A contact module according to claim 1, wherein the first differential pair of terminals extends a greater length than the second differential pair of terminals, the first dielectric constant being lower than the second dielectric constant.

3. The contact module according to claim 1, wherein the first differential pair of terminals extends a greater length than the second differential pair of terminals, each of the first differential pair of terminals comprising a first width and each of the second differential pair of terminals comprising a second width, wherein the first width is greater than the second width.

4. The contact module according to claim 1, wherein the lead frame further comprises a third differential pair of terminals, a third dielectric body surrounds at least a portion of the third differential pair of terminals, the third dielectric body comprising a third dielectric constant that is different than the first and second dielectric constants.

5. The contact module according to claim 1, wherein the first dielectric body surrounds at least a portion of both of the terminals of the first differential pair of terminals and the second dielectric body surrounds at least a portion of both of the terminals of the second differential pair of terminals.

6. The contact module according to claim 1, wherein the first differential pair of terminals is arranged in a first row and the second differential pair of terminals is arranged in a second row, the first and second rows being arranged in a column.

7. A contact module for an electrical connector, said contact module comprising:

a lead frame comprising first and second differential pairs of terminals, each of the terminals extending between a mating edge portion and a mounting edge portion;

a first dielectric body surrounding at least a portion of the first differential pair of terminals, the first dielectric body comprising a first air gap; and a second dielectric body surrounding at least a portion of the second differential pair of terminals, the second dielectric body comprising a second air gap that is smaller than the first air gap of the first dielectric body.

8. The contact module according to claim 7, wherein the first differential pair of terminals extends a greater length than the second differential pair of terminals, the first dielectric body comprising a first dielectric constant that is lower than a second dielectric constant of the second dielectric body.

9. The contact module according to claim 7, wherein the first dielectric body and the second dielectric body are fabricated from the same materials.

10. The contact module according to claim 7, wherein the first differential pair of terminals extends a greater length than the second differential pair of terminals, each of the first differential pair of terminals comprising a first width and each of the second differential pair of terminals comprising a second width, wherein the first width is greater than the second width.

11. The contact module according to claim 7, wherein the lead frame further comprises a third differential pair of terminals, a third dielectric body surrounds at least a portion of the third differential pair of terminals, the third dielectric body comprising a third air gap that is different than the first and second air gaps.

12. A contact module according to claim 7, wherein the first and second dielectric bodies are discrete from each other.

13. The contact module according to claim 7, wherein the first differential pair of terminals is arranged in a first row and the second differential pair of terminals is arranged in a second row, the first and second rows being arranged in a column.

14. An electrical connector comprising:

a housing; and a contact module mounted in the housing and comprising:

a lead frame comprising first and second differential pairs of terminals, each of the terminals extending between a mating edge portion and a mounting edge portion;

a first dielectric body surrounding the first differential pair of terminals along at least a portion of a length and at least a portion of a circumference of the first differential pair of terminals, the first dielectric body comprising a first dielectric constant; and a second dielectric body surrounding the second differential pair of terminals along at least a portion of a length and at least a portion of a circumference of the second differential pair of terminals, the second dielectric body comprising a second dielectric constant that is different than the first dielectric constant of the first dielectric body.

15. The electrical connector according to claim 14, wherein the first differential pair of terminals extends a greater length than the second differential pair of terminals, the first dielectric constant being lower than the second dielectric constant.

16. The electrical connector according to claim 14, wherein the first differential pair of terminals extends a greater length than the second differential pair of terminals, each of the first differential pair of terminals comprising a first width and each of the second differential pair of terminals comprising a second width, wherein the first width is greater than the second width.

17. The electrical connector according to claim 14, wherein the lead frame further comprises a third differential pair of terminals, a third dielectric body surrounds at least a portion of the third differential pair of terminals, the third dielectric body comprising a third dielectric constant that is different than the first and second dielectric constants.

18. An electrical connector comprising:

a housing;

a contact module mounted in the housing and comprising:

a lead frame comprising first and second differential pairs of terminals, each of the terminals extending between a mating edge portion and a mounting edge portion;

a first dielectric body surrounding at least a portion of the first differential pair of terminals, the first dielectric body comprising a first dielectric constant; and a second dielectric body surrounding at least a portion of the second differential pair of terminals, the second dielectric body comprising a second dielectric constant that is different than the first dielectric constant of the first dielectric body; and a holder having an extension received between the first and second dielectric bodies, the extension spacing the first and second dielectric bodies apart from each other.

19. The electrical connector according to claim 14, wherein the first differential pair of terminals is arranged in a first row and the second differential pair of terminals is arranged in a second row, the first and second rows being arranged in a column.

20. The contact module according to claim 1, wherein the first and second dielectric bodies are discrete from each other.

21. The electrical connector according to claim 14, wherein the dielectric body surrounds at least a portion of both of the terminals of the first differential pair of terminals and the second dielectric body surrounds at least a portion of both of the terminals of the second differential pair of terminals.

* * * * *